US011497982B1

(12) United States Patent
Holz

(10) Patent No.: US 11,497,982 B1
(45) Date of Patent: Nov. 15, 2022

(54) SKI POLE RETENTION AND STORAGE APPARATUS

(71) Applicant: Red Rev, LLC, Des Moines, IA (US)

(72) Inventor: Christopher Holz, Des Moines, IA (US)

(73) Assignee: Red Rev, LLC, Des Moines, IA (US)

( * ) Notice: Subject to any disclaimer, the term of this patent is extended or adjusted under 35 U.S.C. 154(b) by 0 days.

(21) Appl. No.: 16/150,849

(22) Filed: Oct. 3, 2018

Related U.S. Application Data

(60) Provisional application No. 62/567,322, filed on Oct. 3, 2017.

(51) Int. Cl.
*A63C 11/02* (2006.01)
*A63C 11/22* (2006.01)
*A63C 9/00* (2012.01)

(52) U.S. Cl.
CPC ..... *A63C 11/025* (2013.01); *A63C 11/228* (2013.01); *A63C 9/00* (2013.01)

(58) Field of Classification Search
CPC ... A63C 11/023; A63C 11/025; A63C 11/026; A63C 11/228; A63C 11/22; A63C 11/221; A63C 11/227; A63C 11/28; A63C 5/06; A45F 2200/0566; A01K 97/08
USPC ..... 224/904, 918, 920, 922; 294/147, 294/162–163; 280/814, 820; 211/70.5
See application file for complete search history.

(56) References Cited

U.S. PATENT DOCUMENTS 4,059,209 A * 11/1977 Grisel ..... A63C 11/009 294/147
4,896,465 A * 1/1990 Rhodes ..... A61M 5/1418 128/849
4,991,413 A * 2/1991 Arnaldo ..... A47F 7/0243 340/572.9
7,556,232 B1 * 7/2009 Begg ..... A47F 7/0243 24/3.12
9,462,796 B1 * 10/2016 Ellis ..... A01K 97/06
2002/0007538 A1 * 1/2002 Bourgerie ..... A01K 97/08 24/517
2007/0114255 A1 * 5/2007 Spadaccini ..... A45F 3/14 224/257

(Continued)

FOREIGN PATENT DOCUMENTS

EP 3693065 A1 * 8/2020 ..... A63C 10/10
GB 2487184 A * 7/2012 ..... A63C 11/221

*Primary Examiner* — Scott T McNurlen
(74) *Attorney, Agent, or Firm* — Brick Gentry Law Firm; Brian J. Laurenzo; Jessica L. Susie

(57) ABSTRACT

The preferred embodiment of an apparatus for ski pole retention and storage is provided. A proximal half of a cuboid bracket embodied in a U-shape is substantially connected, via a hinge, to a distal half of a cuboid bracket embodying the same characteristics. Both the proximal and distal halves are secured with a binding strap and ratchet located on the plane opposite the hinge. The preferred embodiment also comprises of elastic straps that bias the apparatus to an open position. A binding strap is substantially fixed to said proximal half and said binding ratchet is substantially fixed to said distal half. Both the proximal and distal halves of the cuboid bracket have interior surfaces to which high-density foam is substantially connected. The exterior surface of the proximal half of the cuboid bracket comprises a second mechanism by which it attaches the body of the apparatus to a rigid surface.

4 Claims, 5 Drawing Sheets

(56) References Cited

U.S. PATENT DOCUMENTS

| | | | | |
|---|---|---|---|---|
| 2007/0164551 | A1* | 7/2007 | Malone | A63C 10/00 280/823 |
| 2012/0168047 | A1* | 7/2012 | Wilson | E05B 1/0053 150/132 |
| 2016/0346665 | A1* | 12/2016 | West | A63C 10/18 |
| 2017/0173899 | A1* | 6/2017 | Schlegelmilch | B29C 73/14 |

* cited by examiner

SKI POLE RETENTION AND STORAGE APPARATUS

CROSS-REFERENCE TO RELATED APPLICATIONS

This application claims priority from U.S. Provisional Application Ser. No. 62/567,322 filed Oct. 3, 2017 and entitled SKI POLE RETENTION AND STORAGE APPARATUS. The contents of U.S. Provisional Application Ser. No. 62/567,322 is hereby incorporated in its entirety by reference.

FIELD OF THE INVENTION

The present invention relates generally to an apparatus for the retention and storage of ski poles. More specifically, the present invention relates to an apparatus which may receive tri-folded ski poles, fixed length ski poles or telescoping ski poles and may be substantially fixed to a surface. Further the present invention may be used with preexisting snowboard bindings.

BACKGROUND

Ski poles are commonly used in cross-country or mountain slope skiing and less commonly in snowboarding. While not typically employed during a user's decent, the use of ski poles while riding a snowboard becomes particularly useful when traversing flat land. Ski poles are desirable in traversing terrain because they allow the user to create an anchor point in the snow or other various substrate from which to generate momentum and alter trajectory. While useful, if not necessary, to traverse flat land while on snowboard, the use of ski poles while the user descends the slope of a mountain is most often a hindrance. In downhill skiing, the user uses the ski poles to generate momentum, redirect momentum and to provide balance. When properly used, ski poles are held in the hands with the body of poles extending downward longitudinally and travel parallel to the skis and, consequentially, the path of the user. Conversely, during snowboarding the user, as well as the path of travel for the ski poles, is oriented perpendicular to the snowboard. This perpendicular orientation disrupts the user balance and may possibly cause the ski poles to contact the snow thereby limiting the angle at which the user may lean into a turn. Accordingly, this change in orientation makes the use of the ski poles during descent increasingly difficult and unsuitable for snowboarders.

The retention and storage of ski poles has traditionally been inefficient. Common problems with previous storage methods include a low speed of deployment and subsequent storage, the possibility of injury resulting from being struck or impaled by the ski poles during a crash and limitations to the maneuverability of the user. For example, a solution that places the storage mechanism on the arm of a user presents a substantial risk of injury in the event of a crash. Specifically, the inherent flexibility of the user's arm may redirect the point of the ski poles towards the body upon impact. What's more, the sudden deceleration from 25-30 MPH during the event of a crash may potentially cause the ski pole, if not fixed to a rigid object, to strike, impale or lacerate the user.

Additionally, solutions which would place the storage apparatus on the user's back greatly diminishes the user's ability to deploy and subsequently store the ski poles. Beyond the dangers of bodily injury previously mentioned, the human anatomy's resistance to posterior external rotation of the shoulders makes reaching the poles and/or mechanism holding same extremely difficult and results in the need to remove any storage device from that anatomical plane before it can be addressed with any precision. Thus, in order for a user to store ski poles in a backpack or similar system, the user must first remove that system from its carried position before they are able to access the ski poles, making the deployment and storage of said ski poles a slow, cumbersome process.

Furthermore, previous methods of securing ski poles in other fixed positions have been unsuccessful. A simplistic approach of utilizing fabric hook and loop fasteners, or any other friction-based securing method, fails on two fronts. First, the aforementioned method does not possess the requisite strength to secure the ski poles in their intended position during impact. The mere contact with the snow on the extremities of the ski pole while traveling at even casual speeds has the potential to generate enough force to separate the two halves of the fabric hook and loop fasteners resulting in the ski poles become dislodged or lost. Second, fabric hook and loop fasteners, or other friction-based securing methods are prone to fail as they come into contact with snow and ice. Additionally, when the halves of the fabric hook and loop fasteners are left unsecured, the buildup of snow, ice or water may disrupt the interface of the hook and loop causing subsequent closure to be inefficient or impossible.

Accordingly, there is a need in the art for a ski pole retention and storage apparatus that allows for fast deployment and storage, is easy to use and reduces the likelihood of injury upon impact. Additionally, the desired device should not interfere with the user's maneuverability while traversing flat lands or slopes. Moreover, the desired device should be capable of fixation to the body of existing equipment. Other objects and advantages of the invention will be apparent from the drawings and detailed description to follow.

SUMMARY

The present invention provides an apparatus for retaining and storing ski poles and accessories in a safe and convenient manner. In one embodiment of the invention, the ski pole retention and storage apparatus may include a first half and a second half wherein the first half is capable of being secured at various distances to the second half by way of a first mechanism. Also included may be a second mechanism capable of substantially joining the first half with a surface. Moreover, a third mechanism connects the first and second halves on an opposing side of the first mechanism. Further, compressible material may be added to the first half and to the second half. The first mechanism works in conjunction with the third mechanism as well as the compressible material of the first half and the compressible material of the second half such that an object placed between the first half and the second half may be secured in a fixed position by bringing the first half and second half together. When this occurs, the compressible material that comes into contact with an object placed between the first half and the second half becomes compressed and applies pressure to that object as the first half and second half are secured at closer distances. The use of this compressible material allows for a uniform dispersion of pressure across the body of the held object so as to avoid damage or deformation of same and allows for objects of various size and shape to be secured with equal efficacy. The use of the first mechanism, third mechanism and compressible material in this way provides numerous advantages over other methods of ski pole retention. First, the use of compressible material allows for ski poles of various configurations, such as fixed pole, telescoping pole or folding pole, to be secured with the same apparatus. Other methods such as retention clips or hook and loop fasteners are often static in size and can only secure objects of specific dimensions. What's more, the use of compressible material allows for contact with the ski poles over an increased surface area that prevents the likelihood of longitudinal displacement. Retention clips and hook and loop fasters, on the other hand, serve to merely keep the poles within an area of enclosure and impart minimal friction upon the surface of the poles. The lack of surface contact and resulting friction from same may allow for some movement of the poles while the retention devices are in use which could result in the diminished maneuverability of the user or damage to the ski poles.

In another embodiment of the invention, the apparatus may additionally comprise a third mechanism connecting the first half and second half that allows biasing of said first and second halves. The third mechanism of the alternative embodiment may comprise a hinge or other joint capable of extension and flexion. Further, the first mechanism of the apparatus may additionally comprise a strap and a securing device that may receive said strap and is capable of applying force incrementally. The strap of the first mechanism may be attached to the first half of the apparatus while the securing device is attached the second half. Alternatively, the strap of the first mechanism may be attached to the second half of the apparatus while the securing device is attached to the first half.

In another embodiment of the present invention, the apparatus includes a bracket capable of being substantially joined with the back of a snowboard binding. More specifically, the preferred embodiment of the invention provides a cuboid bracket comprising a first half with an internal and external surface and a second half also with an internal and external surface. Further, the cuboid bracket of the preferred embodiment of the invention comprises high-density polyethylene thermoplastic. Alternatively, any material of sufficient strength may be used in place of high-density polyethylene thermoplastic. Additionally, the first half of the cuboid bracket of the preferred embodiment comprises a first side, having at least first and second ends, a second side and a third side. The second and third sides of the first half of the cuboid bracket are located on opposite ends of first side wherein the second side is substantially joined with the first end of the first side in an arcuate corner and the third side is substantially joined with the second end of the first side at an arcuate angles Moreover, the second half of the cuboid bracket of the preferred embodiment comprises a first side, having at least first and second ends, a second side and a third side. The second and third sides of the second half of the cuboid bracket are located on opposite ends of first side wherein the second side is substantially joined with the first end of the first side in an arcuate corner and the third side is substantially joined with the second end of the first side at an arcuate angle. Both the first half and second half of the cuboid bracket are substantially U-shaped and oriented to achieve reflection symmetry whether positioned in an open biased position or closed biased position.

The cuboid bracket of the preferred embodiment additionally comprises compressible material substantially fixed to the internal surface of the first half and to the internal surface of the second half. The compressible material is divided equally between both the first half and second half of the cuboid bracket. In the preferred embodiment of the invention, the compressible material comprises high-density foam. Alternatively, any material sufficient to accommodate the shape of multiple configurations of ski poles may be used in place of high-density foam. Further still, the first half and second half off the cuboid bracket of the preferred embodiment are connected by a third mechanism comprising a metal hinge capable of extension and flexion, as well as a first mechanism to effectuate flexion of the first half and second half of the cuboid bracket. In the preferred embodiment, the first mechanism may comprise a closure strap, substantially joined with the first half, secured by a compatible binding ratchet substantially joined with the second half and preferably located contralateral to the hinge. What's more, one or more biasing members, the body or bodies of which are attached to the exterior surface of the first half, traverse the plane upon which the hinge is located and then is attached to the second half of the cuboid bracket, may be included. In the preferred embodiment, the biasing members are substantially joined with the first half and second half of the cuboid bracket at anchor points. Further, the biasing members comprise of elastic bands; however, any mechanism sufficient to assist in the extension of the metal hinge may be used. Functioning together, the two anchor points on both the first half and second half of the cuboid bracket serve to harness the tension of the elastic strapping in order to bring and hold the hinge open in extension.

In the preferred embodiment of the present invention the first half of the cuboid bracket is substantially joined with the back of the snowboard bindings by way of a mechanism. Preferably the mechanism for substantially joining the cuboid bracket with the back of a snowboard binding comprises one or more bolts and a corresponding number of compatible nuts. The cuboid bracket may be substantially joined with the snowboard binding at an angle of 0-90°, preferably 25-60° and most preferably at 45°.

It is therefore an object of the present invention to provide a new and improved storage and retention device for ski poles that allows users to store their ski poles while using a snowboard.

Another object of the present invention is to provide a new and improved storage and retention device for ski poles that allows users to deploy their poles easily and quickly and to similarly store them again.

A further object of the present invention is to provide a new and improved storage and retention device for ski poles that allows users to safely carry their ski poles while snowboarding.

Yet another object of the present invention is to provide a new and improved storage and retention device for ski poles that is compatible with most or all designs of ski poles.

Other objects, features and advantages of the present invention will become apparent from the detailed description below in light of the accompanying figures.

DETAILED DESCRIPTION

The following is a detailed description of an apparatus 100 for ski pole retention and storage (sometimes "apparatus"). One particular use of such apparatus 100 is the storage of ski poles 400 during snowboard riding activities. Another feature of such an apparatus 100 is its location of attachment which decreases the risk of injury to the user. For ease of discussion and understanding, the following detailed description may refer to the apparatus 100 as a bracket, ski pole bracket, ski pole storage device and/or ski pole retention and storage apparatus. However, it will be appreciated by one skilled in the art that an apparatus 100 of the present invention may be used in any number of circumstances, including, but not limited to, split-boarding, alpine skiing, mountaineering, cross-country skiing, skijoring, or Nordic walking.

Figure 1:
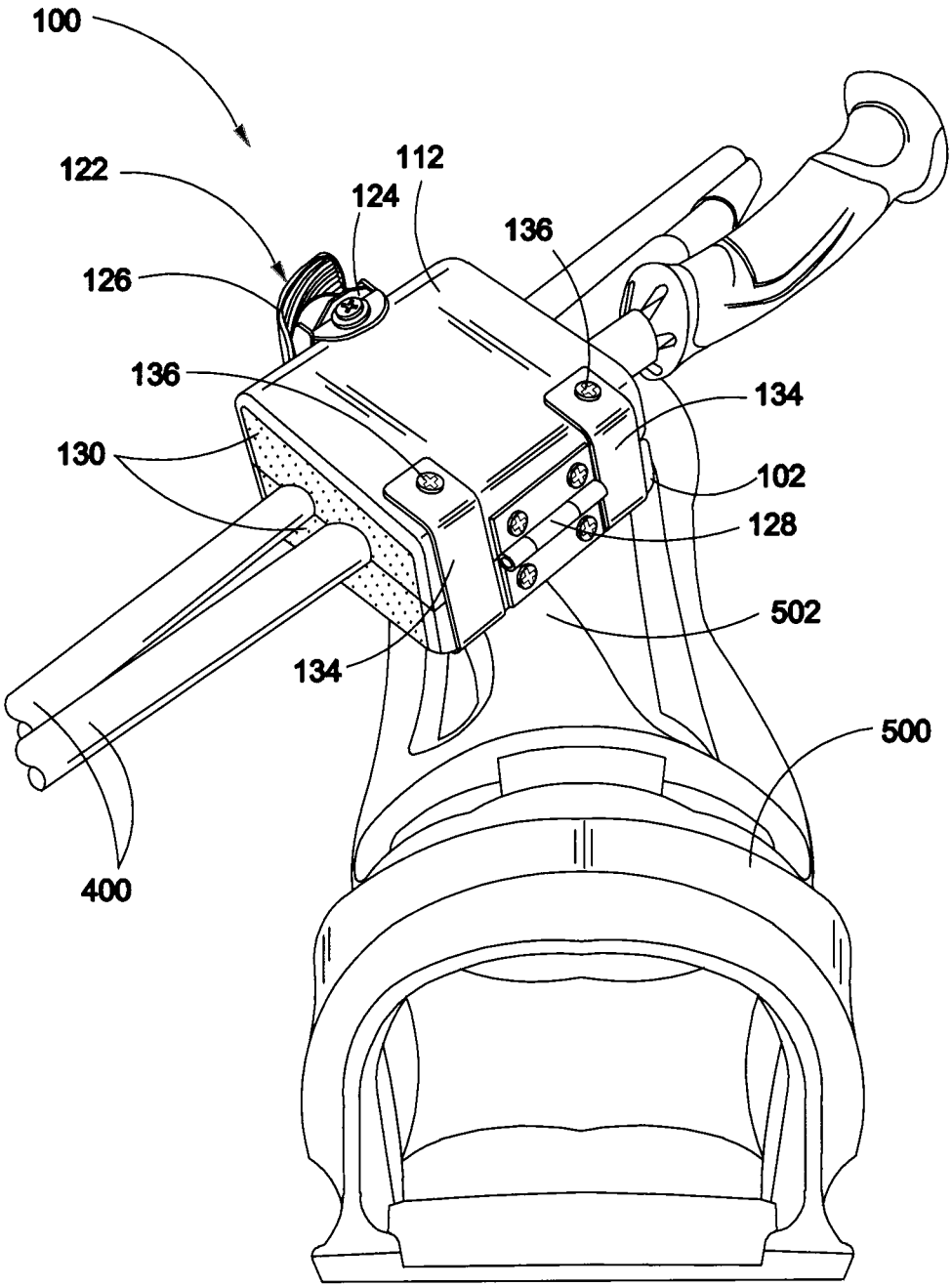
FIG. 1 is a perspective view of an embodiment of a ski pole retention and storage apparatus in the closed position as installed on the posterior side of a snowboard binding and retaining a tri-folded ski pole.

Referring to FIGS. 1 and 6, a ski pole retention and storage apparatus 100 is provided. In the illustrated embodiment, the apparatus 100 includes a first half 102 of a cuboid bracket having an interior surface 110 and a second half 112 of a cuboid bracket having an interior surface 120. In the illustrated embodiment, the first half 102 of the cuboid bracket should be oriented such that the interior surface 110 of the first half 102 is facing the interior surface 120 of the second half 112. Further, the first half 102 of the cuboid bracket is capable of being substantially joined with a surface 502, preferably the back or posterior side of a snowboard binding 502. As is known in the art, snowboard bindings 500 are a component of the snowboard that serve to secure the user's boots to the snowboard with buckles, straps or interlocking brackets. Snowboard bindings 500 are often secured to the snowboard by one or more screws. Additionally, many snowboard bindings 500 feature a rigid support having an anterior side 504 facing the user and a posterior side 502 that faces away from the user. The rigid support of a snowboard binding 500 begins near the heel and extends upwardly, ending near the mid-calf. The purpose of this support is to provide the user with leverage to rotate the snowboard during a turn. The apparatus 100, as depicted in FIG. 1, is preferably, substantially joined with the posterior side 502 of the rigid support of the snowboard binding 500. Additionally, the illustrated embodiment may also include compressible material 130 substantially joined with the interior surface 110 of the first half 102 and interior surface 120 of the second half 112 of the cuboid bracket. Also included may be a first mechanism 122 capable of securing the first half 102 of the cuboid bracket to the second half 112 of the cuboid bracket at varying distances when used in conjunction with a third mechanism 128. When in use, a ski pole 400 may be secured by the apparatus 100 by placing it between the first half 102 and second half 112 of the cuboid bracket and engaging the first mechanism 122 so as to secure the first half 102 to the second half 112. As a consequence, the ski pole 400 will make contact with compressible material 130 located on the first half 102 and second half 112 of the cuboid bracket and apply pressure to said ski pole 400 such that it will be kept in position.

Figure 2:
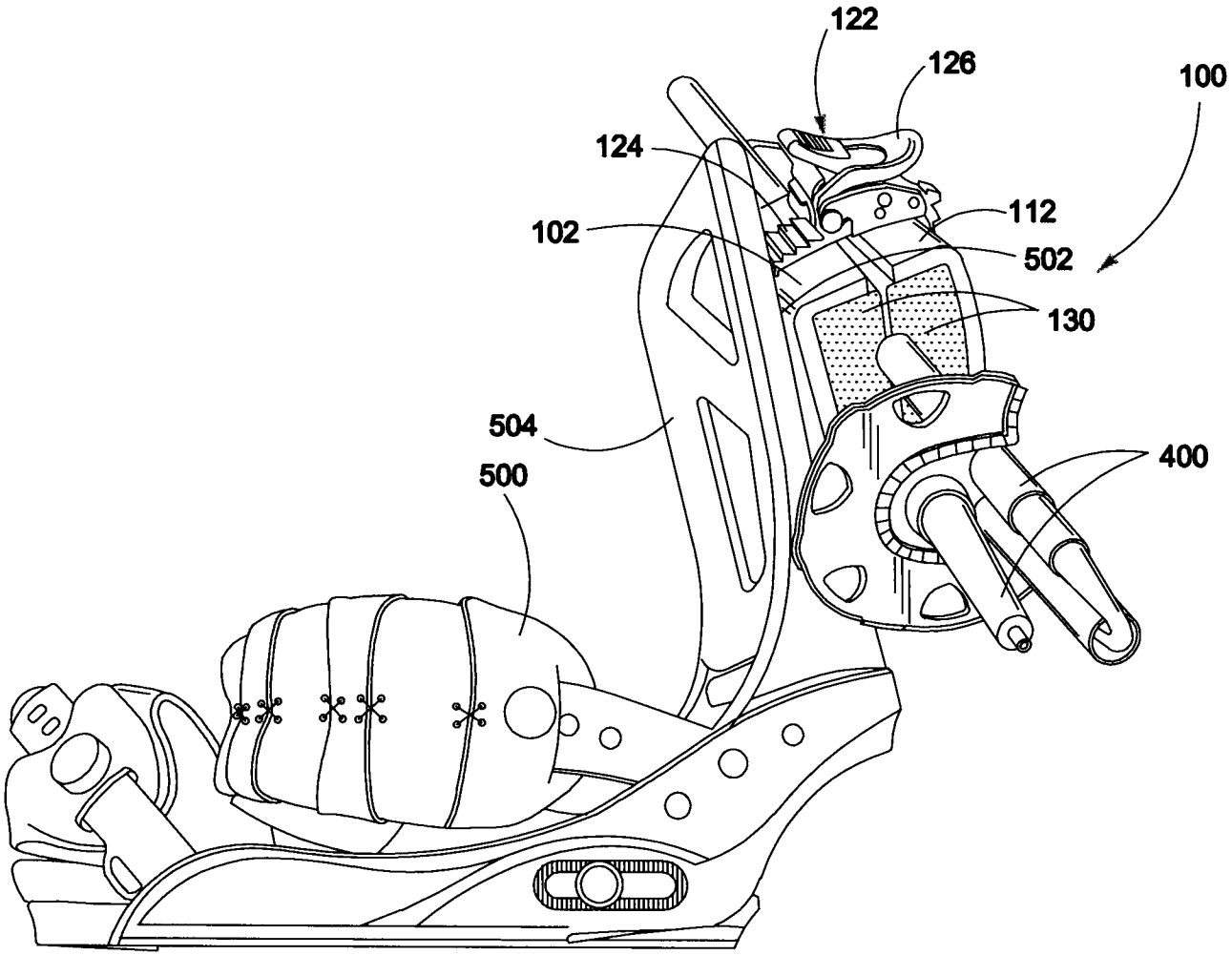
FIG. 2 is a side elevation view of the preferred embodiment of a ski pole retention and storage apparatus in the closed position as installed on the posterior side of a snowboard binding and retaining a tri-folded ski pole.
Figure 3:
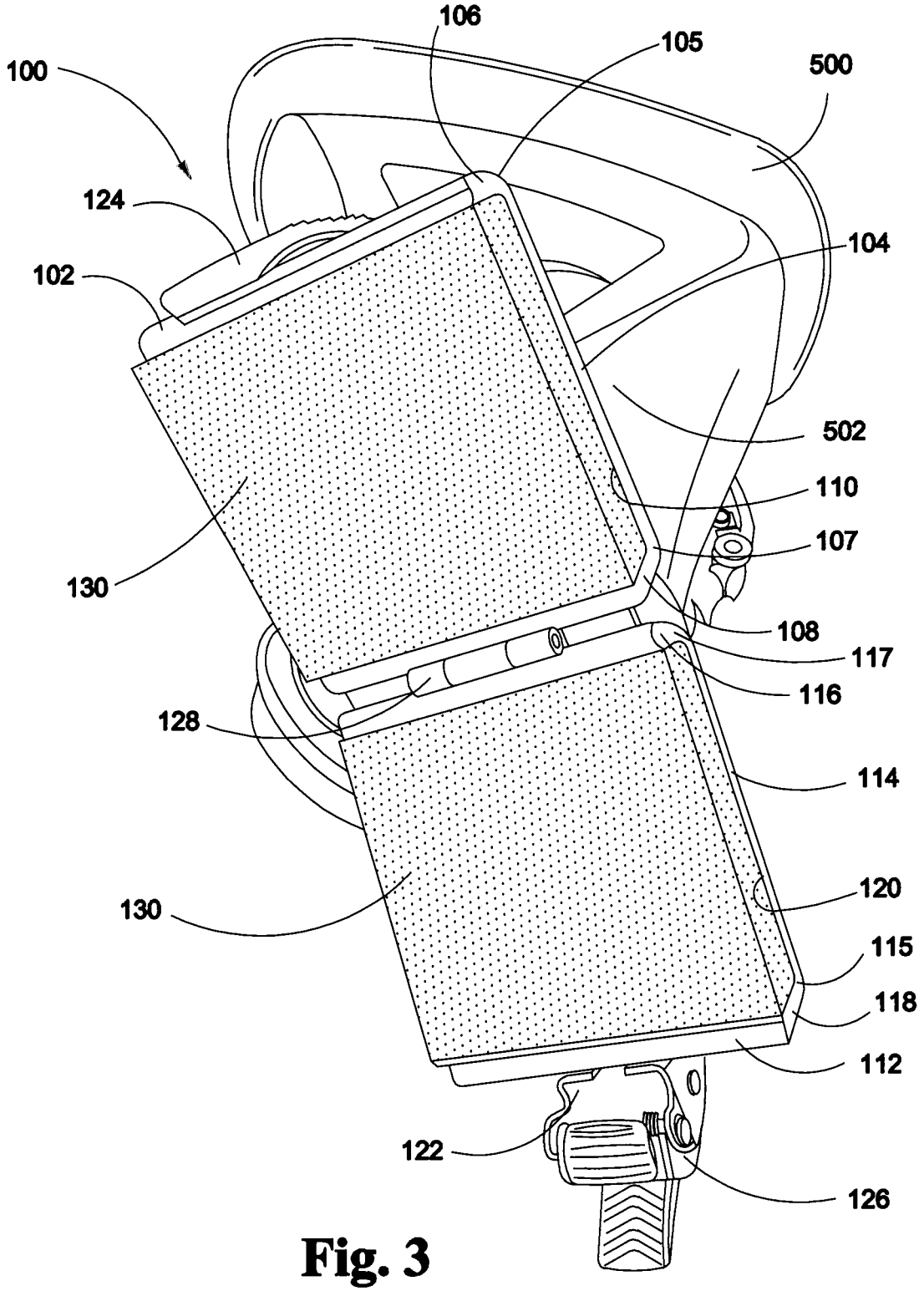
FIG. 3 is a side elevation view of the preferred embodiment of a ski pole retention and storage apparatus in the open position.
Figure 4:
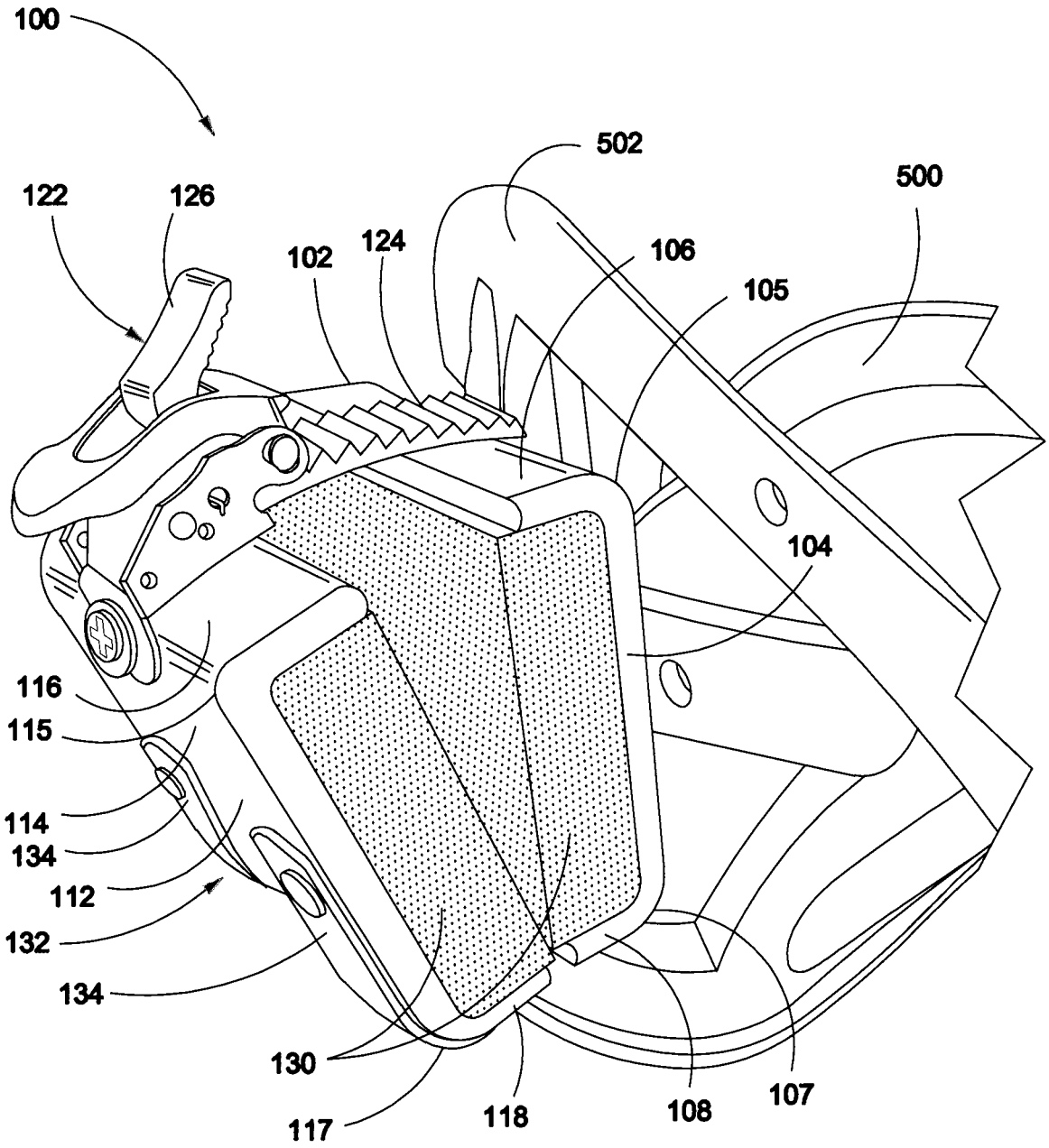
FIG. 4 is a side elevation view of the preferred embodiment of a ski pole retention and storage apparatus in the closed position.
Figure 5:
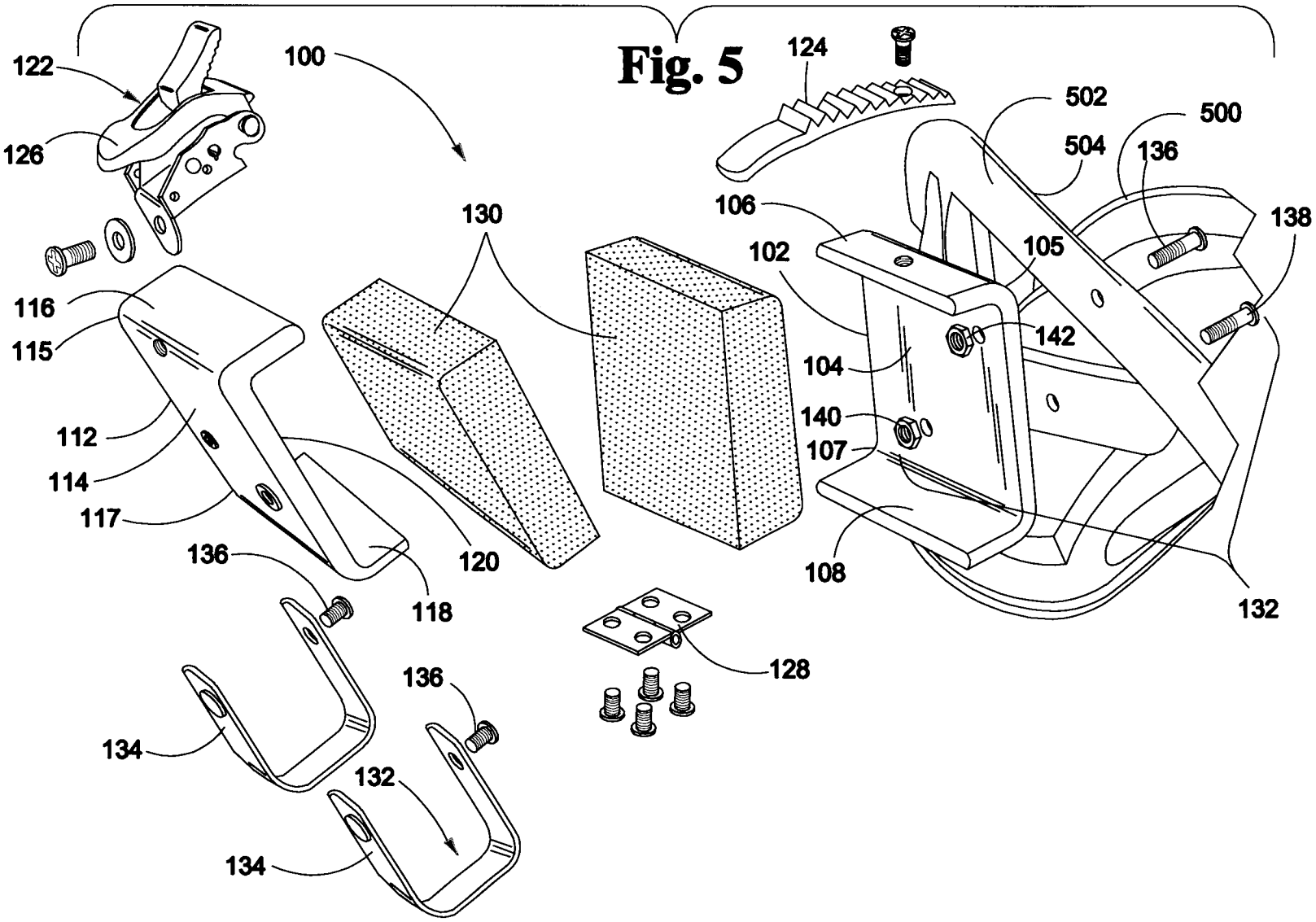
FIG. 5 is an exploded view of an embodiment of a ski pole retention and storage apparatus

Referring to FIGS. 2, 3 and 4 which illustrate the preferred embodiment of the invention, a ski pole retention and storage apparatus 100 is shown. The apparatus 100 of the preferred embodiment includes a cuboid bracket comprising a first half 102, having an interior surface 110, and a second half 112, also having an interior surface 120. Both the first half 102 and the second half 112 of the cuboid bracket are preferably made of a polymer material and more preferably high-density polyethylene thermoplastic. The use of high-density polyethylene thermoplastic provides advantages in that it reduces the overall weight of the apparatus 100 without diminishing its strength and allows for first half 102 and second half 112 of the cuboid bracket to be easily shaped and manufactured. However, it should be appreciated by one skilled in the art that any material of sufficient strength to hold the ski pole 400 in a fixed position may be used in the first half 102 or second half 112 of the cuboid bracket in place of high-density polyethylene thermoplastic. As shown in FIGS. 3 and 4, the first half 102 of the cuboid bracket comprises a first side 104 having at least a first end 105 and second end 107, a second side 106, and a third side 108 wherein the first side 104 is oriented substantially perpendicular to a lower horizontal plane and the second side 106 and third side 108 are oriented substantially parallel to said lower plane. The second side 106 of the first half 102 of the cuboid bracket is substantially joined with the first end 105 of the first side 104 of the first half 102; preferably in an arcuate corner. Additionally, the third side 108 of the first half 102 of the cuboid bracket is substantially joined with the second end 107 of the first side 104 of the first half 102; preferably in an arcuate corner. Accordingly, the first half 102 of the preferred embodiment is thus substantially U-shaped.

Referring again to FIGS. 3 and 4, the second half 112 of the cuboid bracket comprises of a first side 114 having at least a first end 115 and second end 117, a second side 116 and a third side 118 wherein the first side 114 is oriented substantially perpendicular to a lower horizontal plane and the second side 116 and third side 118 are oriented substantially parallel to said lower plane. The second side 116 of the second half 112 of the cuboid bracket is substantially joined with the first end 115 of the first side 114 of the second half 112; preferably in an arcuate corner. Additionally, the third side 118 of the second half 112 of the cuboid bracket is substantially joined with the second end 117 of the first side 114 of the second half 116; preferably in an arcuate corner. As such, the second half 112 of the preferred embodiment is thus substantially U-shaped. However, it should be appreciated by one skilled in the art that the shape of the first half 102 and second half 112 of the bracket may be any shape desired that is capable of holding a ski pole 400 without departing from the scope of the present invention.

Referring again to FIG. 3, the preferred embodiment of the prevent invention is shown biased in the open position. The preferred embodiment of the present invention 100 comprises a first half 102 and second half 112 of a cuboid bracket capable of biasing and maintaining either and open or closed position (as shown in FIG. 4). Closure of the device 100 is made possible through use of a first mechanism 122. The first mechanism 122 comprises a strap 124 capable of being inserted into a securing device 126. In the preferred embodiment of the present invention 100, the strap 124 consists of a snowboard binding strap 124. Further, the securing device 126 of the first mechanism 122 of the apparatus 100 preferably comprises a ratchet buckle 126. As is known in the art, a snowboard binding strap 124 comprises an adjustable strap having latching notches perpendicular to the strap. Also known in the art, a ratchet buckle 126 comprises a notched cylinder capable of being turned by a lever when said lever is pulled. The notched cylinder of the ratchet buckle 126 interfaces with the latching notches of the snowboard binding strap 124 such that the operation, and subsequent rotation of the notched cylinder, causes the snowboard binding strap 124 to be drawn into and through the ratchet buckle 126. Accordingly, a user may insert the snowboard binding strap 124 into the ratchet buckle 126 and operate said ratchet buckle 126 in order to adjust the distance at which the first half 102 of the cuboid bracket is secured to the second half 112.

The illustrated embodiment further comprises a third mechanism 128 which is located at the most inferior point of the invention 100 upon proper installation. The third mechanism 128 preferably comprises a metallic hinge 128. However, it should be appreciated by one skilled in the art that the third mechanism 128 may comprise of any mechanism that allows sufficient movement of the first and second halves 102 and 112 and may comprise of any material of sufficient strength without departing from the scope of the invention. The hinge 128 is located with each of its movable planar surfaces on either the first half 102 or second half 112, but not both the first half 102 and second half 112, of the cuboid bracket. Further, the hinge 128 should be located in a medial position of the planar surface to which it is affixed and opposite that of the securing device 126 and strap 124 of the first mechanism 122 when closed. Closure occurs when the first mechanism 122 is engaged and causes the first half 102 and second half 112 of the cuboid bracket to pivot at the hinge 128 such that the interior 110 of the first half 102 is facing the interior 120 of the second half 112. In the preferred embodiment of the apparatus, the first mechanism 122 may be engaged by inserting the strap 124 into the corresponding securing device 126 as far as desired. Consequentially, this practice permits the invention 100 to accommodate a number of ski pole 400 configurations by allowing the user to fit larger objects in the apparatus 100 and by allowing the user to increase amount of pressure applied incrementally on the fitted object. Further, the preferred embodiment of the apparatus 100 may be placed in the open position by disengaging the first mechanism 122 and extending the second half 112 of the cuboid bracket such that the first side 104 of the first half 102 and first side 114 of the second half 112 of the cuboid bracket are approximately at a 180° angle. However, it should be appreciated by one skilled in the art that any closure mechanism 122 and/or hinge mechanism 128 may be utilized without departing from the scope of the present invention.

Furthermore, in the illustrated embodiment of the present invention, the interior 110 of the first half 102 of the cuboid bracket is filled with a volume of compressible material 130. Additionally, the interior 120 of the second half 112 of the cuboid bracket is filled with a volume of compressible material 130. The compressible material 130 of the interior 110 of the first half 102 and interior 120 of the second half 112 of the cuboid bracket preferably comprises high density foam 130. However, it should be appreciated by one skilled in the art that any material sufficient to accommodate the shape of various configurations of ski poles may be used in place of the high-density foam 130 without departing from the scope of the present invention. The volume of the compressible material 130 is contemplated to fill the interior volume of the first half 102 and second half 112 of the cuboid bracket. Specifically, the volume of compressible material 130 located in the first half 102 of the cuboid bracket may extend to but should not extend beyond, the dimensions of the first side 104, second side 106 and third side 108 of the first half 102 as oriented in the preferred embodiment. Additionally, the volume of compressible material 130 located in the second half 112 of the cuboid bracket may extend to but not beyond, the dimensions of the first side 114, second side 116 and third side 118 of the second half 112 as oriented in the preferred embodiment. The addition of compressible material 130 allows for the apparatus 100 to apply sufficient pressure to secure a myriad of differing ski pole 400 configurations. More specifically, the strap 124 and corresponding securing device 126 of the first mechanism 122 works in conjunction with the compressible material 130 to apply uniform pressure along the body of the ski pole 400 to keep it in place. The compressible material 130 that contacts the ski pole 400 becomes compressed as the first half 102 and second half 112 of the cuboid bracket are secured at closer distances to each other. Because the compressible material 130, when compressed, gives way to the body of the ski pole 400, the compressible material 130 allows for increased surface contact with the ski pole 400. This increased area of surface contact not only serves to keep the ski pole 400 within the cuboid bracket, but also increases the coefficient of friction between the ski pole 400 and the compressible material 130 such that the ski pole 400 does not become longitudinally displaced from its carried position. Additionally, although not necessary, it is contemplated that complimentarily shaped cutouts in the compressible material 130 may be utilized to more securely hold a particular ski pole 400 or to accommodate multiple ski poles 400. Alternatively, it is contemplated that compressible material 130 of differing densities may be used for the purposes of accommodating specific ski poles 400 or multiple ski poles 400.

As shown in FIGS. 1 and 4, the preferred embodiment of the present invention 100 further provides one or more biasing members 134 which are substantially joined to the first half 102 and the second half 112 of the cuboid bracket. The biasing member(s) 134 are preferably attached to the first half 102 of the cuboid bracket by one or more stainless steel anchors screws 136 and to the second half 112 of the cuboid bracket by one or more steel anchor screws 136. The preferred embodiment contemplates the use of ¾" elastic strapping as the biasing member 134. However, it should be appreciated by one skilled in the art that any material or combination of materials may be utilized as biasing the member 134 and anchors 136 without departing from the scope of the present invention 100. The one or more biasing members 134 attach to the first 104 side of the first half 102 of the cuboid bracket, through the plane in which the hinge 128 is located and to the first side 114 of the second half 112 of the cuboid bracket. The use of the biasing member(s) 134 in this manner assists the user in placing the apparatus 100 in a biased opened position by imparting leverage on the hinge 128. This leverage on the hinge 128 causes both the first half 102 and second half 112 of the cuboid bracket to pivot on the hinge 128 to the desired position. It should be appreciated by one skilled in the art that any number of ways to impart leverage on a hinge 128 to bias its position and any number of now know or future contemplated method of extension may be used without departing from the scope of the present invention.

Referring to FIG. 4, the preferred embodiment of the present invention is shown. The preferred embodiment of the present invention 100 additionally comprises a second mechanism 132. As shown in the illustrated embodiment the apparatus 100 may be substantially joined with the posterior surface 502 of the snowboard binding. Specifically, the apparatus 100 may be fixed in place by one or more securing bolts 136 and an equal number of compatible metallic nuts 140. The contemplated apparatus 100 of the present invention includes a first bolt 136 and corresponding first nut 140 as well as a second bolt 138 and corresponding second nut 142 in a staggered layout, but any number or layout of bolts can be used without departing from the scope of the present invention. The first bolt 136 and second bolt 138 may be inserted through the first side 104 of the first half 102 of the cuboid bracket, and continue through one or more corresponding holes, either already existing or made by the user, beginning on the posterior surface 502 of the snowboard binding 500 and through to the anterior surface 504 wherein the first bolt 136 is secured by the corresponding first nut 140 and the second bolt 138 is secured by the corresponding second nut 142. However, it should be appreciated by one skilled in the art that any now know or future contemplated mounting mechanism with sufficient strength to hold the apparatus 100 and retained ski pole 400 can be utilized without departing from the scope of the present invention.

As shown in FIGS. 1, 2 and 3, the apparatus of the preferred embodiment should be substantially joined to the posterior surface 502 of the snowboard binding 500 at an angle of 15-70°, preferably 25-60° and most preferably at 45°. Orienting the apparatus 100 at such angles provides numerous benefits. First, placing the apparatus 100 substantially vertical, at best, interferes with a user's maneuverability and, at worst, can result in injury during a crash. Specifically, placement of the apparatus 100 at a substantially 90° angle could potentially result in impalement of the user's leg should it come into contact with tip of the ski pole 400 as the angle between the user's thigh and the snowboard binding 500 lessens. Further, placement of the apparatus 100 such that it is substantially horizontal may potentially interfere with the maneuverability of the user while riding, entering the snowboard bindings, or exiting the snowboard bindings. Conversely, placement of the apparatus 100 at the most preferable angle eliminates these two concerns as such an angle does not present an obstacle to the user or diminish their maneuverability and places either end of the ski pole 400 out of path of travel of the user's leg.

Although various representative embodiments of this invention have been described above with a certain degree of particularity, those skilled in the art could make numerous alterations to the disclosed embodiments without departing from the spirit or scope of the inventive subject matter set forth in the specification and claims. Joinder references (e.g. fixed, connected, secured, etc.) are to be construed broadly and may include intermediate members between a connection of elements and relative movement between elements. As such, joinder references do not necessarily infer that two elements are directly connected and in fixed relation to each other. Moreover, network connection references are to be construed broadly and may include intermediate members or devices between a network connection of elements. As such, network connection references do not necessarily infer that two elements are in direct communication with each other. In some instances, in methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements and/or substantial equivalents.

What is claimed is:

1. An apparatus in combination with a snowboard binding, said apparatus to be used with at least one ski pole and comprising:

a. a body comprising a first half, having an interior and exterior surface and a second half, having an interior and exterior surface;

b. wherein said first half comprises a first side, having at least a first end and second end, oriented substantially perpendicular to a lower horizontal plane and second side and third side oriented substantially parallel to said lower plane;

c. wherein said second side and said third side are located and joined with the first side at opposite ends;

d. wherein a second half comprises a first side, having at least a first end and second end oriented substantially perpendicular to a lower horizontal plane and a second side and third side are oriented substantially parallel to said lower plane;

e. wherein said second side and said third side are located and joined with the first side at opposite ends;

f. wherein said first half and said second half are oriented to achieve reflection symmetry;

g. wherein said exterior surface of said second side of said first half and said exterior surface of said second side of said second half are joined by a mechanism capable of extension and flexion;

h. wherein said interior surface of said first half and the interior surface of said second half contain compressible material;

i. wherein said second half comprises a locking device capable of releasably receiving a complimentarily-shaped member capable of insertion into said locking device;

j. wherein said first half further comprises said member capable of insertion into said locking device; and k. wherein said exterior surface of said first side of said first half further comprises a second mechanism securing said first half to said snowboard binding such that said apparatus is configured to hold at least one ski pole at an angle of 15-70° to a snowboard to which the binding is attached.

2. The apparatus of claim 1 wherein the extension and flexion mechanism comprises a hinge situated on a cuboid bracket, said hinge having movable planar surfaces and located with each of said movable planar surfaces on only one of either the first half or second half of said cuboid bracket.

3. The apparatus of claim 1 wherein the first half further comprises a biasing member connecting the first half and the second half to allow biasing of said first half and said second half.

4. The apparatus of claim 1 wherein the second mechanism comprises two bolts having heads secured on the interior surface of the side of the first half which extend through to the exterior surface of said first side and are configured to continue through the posterior surface of said snowboard binding to be secured by two nuts on the anterior side of said snowboard binding.

* * * * *